US005278379A

United States Patent [19]

Takanashi

[11] Patent Number: 5,278,379

[45] Date of Patent: Jan. 11, 1994

[54] CONTINUOUS DENITRATION APPARATUS WHICH USES MICROWAVE HEATING

[75] Inventor: Yoshiharu Takanashi, Katsuta, Japan

[73] Assignee: Doryokuro Kakunenryo Kaihatsu Jigyodan, Tokyo, Japan

[21] Appl. No.: 740,615

[22] Filed: Aug. 5, 1991

[30] Foreign Application Priority Data

Aug. 14, 1990 [JP] Japan ..... 2-214662

[51] Int. Cl.[5] ..... H05B 6/64

[52] U.S. Cl. ..... 219/679; 252/643; 252/634; 204/157.15; 422/159; 422/186; 219/685; 219/762

[58] Field of Search ..... 219/10.55R, 10.55A, 10.55E, 10.55F, 10.55M, 10.491, 10.492, 10.51, 10.61, 10.75, 10.57; 252/643, 252/634, 635, 630, 632; 204/157.1R, 157.1P; 422/159, 186, 187, 199; 210/358; 159/11R, 1/10; 159/29

[56] References Cited

U.S. PATENT DOCUMENTS

| | | | |
|---|---|---|---|
| 4,056,482 | 11/1977 | Schmieder et al. | 252/301.1 W |
| 4,334,953 | 6/1982 | Sridhar | 159/11 R |
| 4,364,859 | 12/1982 | Ohtsuka et al. | 252/643 |
| 4,444,723 | 4/1984 | Matsumaru et al. | 422/159 |
| 4,727,231 | 2/1988 | Hayano et al. | 219/10.55 R |
| 4,940,865 | 7/1990 | Johnson et al. | 219/10.55 A |
| 4,957,630 | 9/1990 | Bratten | 210/358 |

FOREIGN PATENT DOCUMENTS 62-79394 of 1987 Japan .
63-22554 of 1988 Japan .

*Primary Examiner*—Bruce A. Reynolds
*Assistant Examiner*—Tu Hoang
*Attorney, Agent, or Firm*—Wenderoth, Lind & Ponack

[57] ABSTRACT

A continuous denitration apparatus by microwave heating comprises an oven into which microwaves are applied and a cylindrical rotary drum disposed horizontally and rotatably disposed inside the oven. The rotary drum has the outer peripheral surface composed of a honeycomb or porous sheet-like microwave dielectric member. Inside the oven are disposed a trough for storing a nitrate solution of a nuclear fuel material below the rotary drum so as to immerse a lower portion of the outer peripheral surface of the rotary drum in the solution stored inside the trough, a heater above the rotary drum so as to heat the outer peripheral surface of the rotary drum opposing the heater, and a scraper for scraping off a denitrated product formed on the outer peripheral surface of the roatray drum between the heater and the trough. Retention of the nitrate solution, heating and denitration of the solution by microwaves, heating and drying of the resulting denitrated product by the heater, and scraping-off of the dried denitrated product from the rotary drum are sequentially carried out in the above-described order at specific positions on the rotary drum while the rotary drum rotates once.

5 Claims, 2 Drawing Sheets

CONTINUOUS DENITRATION APPARATUS WHICH USES MICROWAVE HEATING

BACKGROUND OF THE INVENTION

The present invention relates to a continuous treating apparatus for heating and denitrating a nitrate solution such as a solution of plutonium nitrate, uranyl nitrate, a mixture thereof or the like and converting the nitrate solution to oxide powder. More particularly, the present invention relates to an apparatus for heating and denitrating continuously and efficiently the nitrate solution of nuclear fuel materials by microwaves.

Methods and apparatus of various systems have been developed heretofore for heating and denitrating the nitrate solution of nuclear fuel materials, such as a solution of plutonium nitrate, uranyl nitrate, a mixture thereof, or the like, recovered by reprocessing of spent nuclear fuels and for converting it to a denitrated product composed of oxides by using microwaves. As a continuous treating apparatus in particular, a screw-type apparatus (e.g. Japanese Patent Publication No. 22554/1988) and a turn table-type apparatus using a plurality of vessels (e.g. Japanese Patent Laid-Open No. 79394/1987) have been proposed.

The advantage of the method which converts the nitrate solution to the denitrated product by heating and denitrating the nitrate solution by microwaves is that the resulting denitrated product becomes a porous foamed body because the material to be treated is heated from inside by microwaves.

However, the denitrated product produced actually by using the above-described conventional continuous treating apparatus is in most cases hard and mass-like and is not entirely satisfactory from the aspects of handlability of the product and dischargeability from the apparatus. The maintenance and inspection properties of the prior art apparatus is also not satisfactory.

SUMMARY OF THE INVENTION

An object of the present invention therefore is to provide a continuous denitration apparatus by microwave heating in which the resulting denitrated product is a powdery oxide which is porous, soft and is hence easy to handle and to discharge.

Another object of the present invention is to provide a denitration apparatus by microwave heating which can efficiently carry out continuous treatment.

In order to accomplish the above-described objects, a continuous denitration apparatus by microwave heating according to the present invention comprises an oven into which microwaves are applied and a cylindrical rotary drum having a horizontal rotary shaft and rotatably disposed inside the oven. The rotary drum has the outer peripheral surface composed of a honeycomb or porous sheet-like microwave dielectric member. A trough for storing a nitrate solution of nuclear fuel material as a substance to be treated is disposed inside the oven below the rotary drum in the arrangement such that a lower portion of the outer peripheral surface of the rotary drum is immersed in the nitrate solution stored inside the trough. A heater is disposed inside the oven above the rotary drum in such a manner as to be able to heat the outer peripheral surface of the rotary drum opposing the heater. A scraper is disposed inside the oven for scraping off a denitrated product produced from the nitrate solution and formed on the outer peripheral surface of the rotary drum between the heater and the trough. The oven is further provided with a solution feed port for supplying the nitrate solution into the trough, a denitrated product discharge port for discharging the denitrated product outside the oven, and a gas exhaust port for exhausting a gas generated inside the oven.

By the apparatus of the present invention having the structure described above, retention of the solution to be treated → heating and denitration of the solution by microwaves → heating and drying of the resulting denitrated product by the heater → scraping-off of the dried denitrated product are sequentially carried out in the above-described order at specific positions on the outer peripheral surface of the rotary drum while the rotary drum rotates once, and continuous heating and denitrating treatment can be made efficiently.

Particularly in the present invention, the nitrate solution to be treated is retained by the individual holes of the honeycomb or porous sheet-like microwave dielectric member which is fitted to the outer peripheral surface of the rotary drum and is heated and denitrated inside each hole to provide a foamed body. It is thus possible to obtain oxide powder which is soft, has a uniform particle size and is easily dischargeable by scraping off the denitrated and foamed product formed on the surface of the microwave dielectric member.

PREFERRED EMBODIMENTS OF THE INVENTION

Figure 1A:
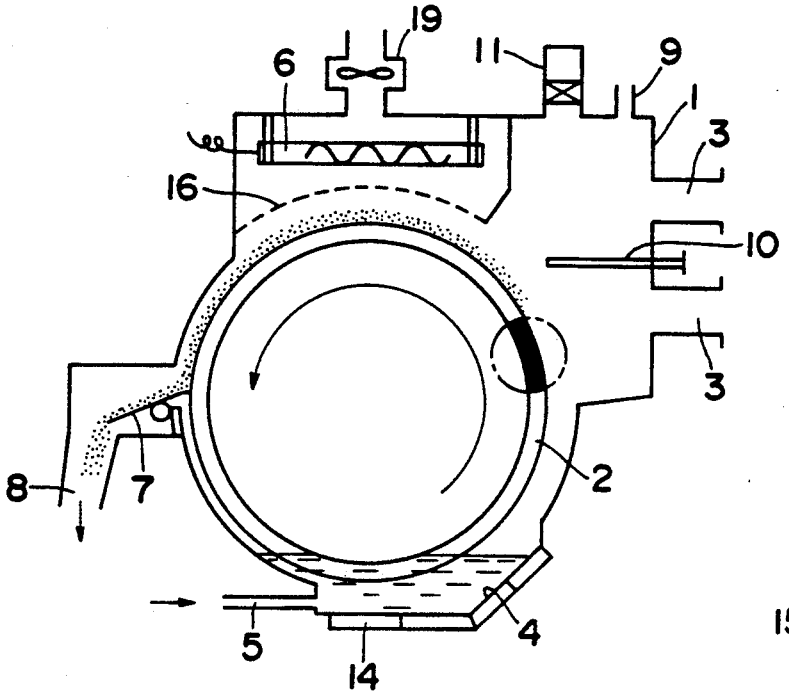
FIG. 1 is a sectional view showing an embodiment of the apparatus of the present invention.
Figure 1B:
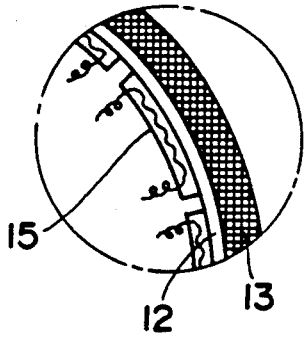

FIG. 1 shows an embodiment of a continuous denitrating apparatus by microwave heating in accordance with the present invention. A cylindrical rotary drum 2 having a horizontal rotary shaft is rotatably disposed inside an oven 1 into which microwaves are applied from microwave waveguides 3, 3. A trough 4 for storing a nitrate solution of nuclear fuel materials such as a solution of plutonium nitrate, uranyl nitrate or the like as a substance to be treated is disposed below the rotary drum 2 inside the oven 1 and the solution is supplied from a solution feed port 5 into the trough 4. The position of the trough and the supply quantity of the solution are determined to such an extent that part of the lower portion of the outer peripheral surface of the rotary drum 2 is immersed in the solution stored in the trough. A heater 6 is disposed inside the oven 1 above the rotary drum 2 and can heat the denitrated product that is formed on the outer peripheral surface of the rotary drum 2. A scraper 7 for scraping off the denitrated product of oxides formed on the outer peripheral surface of the rotary drum is disposed between the heater 6 and the trough 4 downstream of the heater 6 as viewed from the rotating direction of the rotary drum 2. A discharge port 8 is provided to the oven 1 in order to discharge the denitrated product that has been scraped off. This denitrated product discharge port 8 can prevent the leak of microwaves. A gas exhaust port 9 is disposed at the top of the oven 1 in order to exhaust the water vapor and nitric acid vapor that are generated due to heating an denitration of the substance to be treated inside the oven 1 and nitrogen oxides that are formed at the time of decomposition of nitric acid. In FIG. 1, reference numeral 10 represents a microwave controller for regulating the microwave field inside the oven 1 and reference number 11 does an inspection window for observing the heating condition inside the oven 1 from outside.

Figure 2:
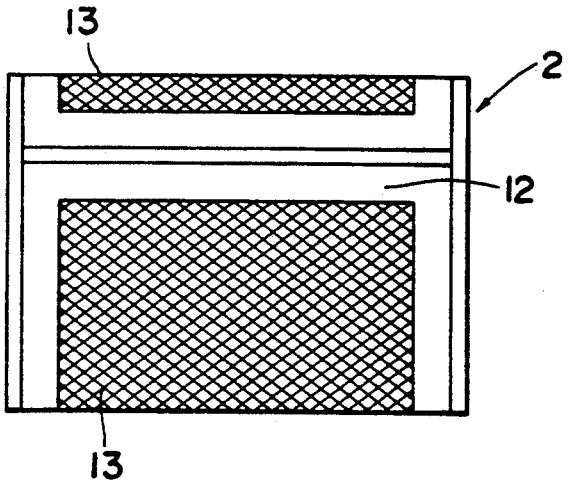
FIG. 2 is a plan view of a rotary drum used in the apparatus of the present invention.

As shown in a partial enlarged view of FIG. 1 and in FIG. 2, the outer periphery of the rotary drum 2 has a structure in which a honeycomb or porous sheet-like microwave dielectric member 13 is mounted on a compact sheet 12 of a microwave dielectric. Silicon nitride and zirconium oxide having relatively high microwave transmissibility are used preferably as a microwave dielectric material.

The operation of the apparatus described above is as follows. To begin with, when part of the lower portion of the honeycomb or porous sheet-like microwave dielectric member 13 forming the outer peripheral surface of the rotary drum 2 is immersed in the nitrate solution of the nuclear fuel material which is stored inside the trough 4 so as to attain a predetermined level, the solution is retained in the individual holes of the honeycomb or porous sheet-like member 13. The solution retained on the outer peripheral surface of the rotary drum 2 moves gradually with the rotation of the rotary drum into the space inside the oven 1 into which microwaves are applied, is heated and concentrated by microwaves and is further denitrated to produce foamed body. In this manner the foamed denitrated product is formed on the surface of the microwave dielectric member 13 on the outer peripheral surface of the rotary drum 2. The denitrated product moves gradually to the upper portion inside the oven 1 with the rotation of the rotary drum 2 and is further heated to about 400° to about 500° C. by the heater 6, so that remaining moisture and nitrate radical in the denitrated product are evaporated and decomposed, thereby providing dry oxides whose oxidation state has further proceeded. The oxides move downward to the portion of the scraper 7 with the rotation of the rotary drum 2, are scraped off by the scraper 7 and are then discharged outside the oven 1 from the denitrated product discharge port 8.

The surface of the rotary drum 2 after the denitrated product is scraped off continues to rotate successively, is again immersed in the solution to be treated inside the trough 4, and retains the solution in the honeycomb or porous sheet-like microwave dielectric member 13 on its outer surface. In this manner, denitration by microwave heating → heating and drying of the resulting denitrated product by the heater 6 → and scraping-off of the dry denitrated product are repeated in this order with the rotation of the rotary drum 2.

In the scraping-off operation of the denitrated product by the scraper 7, a part of the product projecting from each hole of the honeycomb or porous sheet-like microwave dielectric member 13 is scraped off. The other part of the denitrated product remaining in each hole rotates as such with the rotation of the rotary drum 2, comes into contact with the solution inside the trough 4 and is dissolved and treated in the subsequent cycle.

The solution to be supplied into the trough 4 is preferably a relatively concentrated solution having a high viscosity. In order to concentrate the solution in the trough, an external heater 14 capable of controlling the temperature may be disposed on the outer wall of the trough 4 positioned outside the oven as shown in FIG. 1.

Furthermore, as shown in the partial enlarged view of FIG. 1, a temperature-controllable heater 15 may be further disposed inside the microwave dielectric member 13 on the outer peripheral surface of the rotary drum 2. The dielectric member 13 is heated by the heater 15 and the solution retained by the heated dielectric member 13 is further heated and concentrated on the dielectric member 13 before it enters the microwave field. Therefore, the solution whose concentration has thus made higher than the solution inside the trough 4 can be heated and denitrated more efficiently by microwaves.

If any metal projection such as the heater 6 exists inside the microwave field, it will result in the occurrence of electric discharge. Therefore, a microwave shield plate 16 may preferably be disposed around the heater 6.

Figure 3:
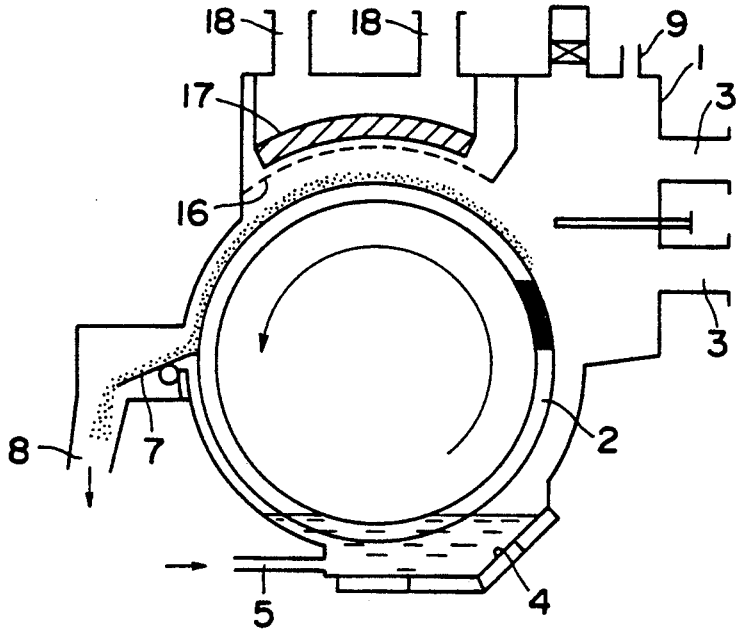
FIG. 3 is a sectional view showing another embodiment of the apparatus of the present invention.

It is also possible, as shown in FIG. 3, to dispose a microwave absorption member 17 such as silicon carbide in place of the heater 6, to apply microwaves via microwave waveguide 18, 18 to the microwave absorption member 17 to cause generation of heat in the latter and thus to heat the denitrated product on the surface of the rotary drum 2. In the present specification, heat generation means using the mcirowave absorption member 17 such as shown in FIG. 3 is also included in the term "heater" in its broad meaning.

Heating and drying of the denitrated product by the heater 6 can be carried out more efficiently by disposing a blower 19 such as a fan above the heater 6 as shown in FIG. 1 so as to supply air or an inert gas (such as nitrogen or argon) from the blower 19 and heating and drying the denitrated product by the gas heated by the heater 6. In this case, the lower surface of the microwave shield plate 16 is opened in the form of a grid or circular hole. Even if the opening is formed in the microwave shield plate 16, microwave can be shielded if the thickness of the microwave shield plate is twice the diameter of the opening.

In accordance with the apparatus of the present invention having the structure described above, heating and denitration by microwaves and furthermore, heating and drying by the heater are carried out while the solution to be treated is retained inside the individual holes of the honeycomb or porous sheet-like microwave dielectric member. Accordingly, porous, soft and easily dischargeable denitrated oxide powder can be obtained and moreover, continous treatment can be carried out efficiently.

The structure of the apparatus can be obtained by disposing merely the honeycomb or porous sheet-like microwave dielectric member on the outer peripheral surface of a drum filter, for example, that has been used conventionally in the past, and by combining them with a microwave heating oven and a heater. Therefore, the apparatus of the invention can be manufactured easily by utilizing existing technology.

What is claimed is:

1. A continuous denitration apparatus comprising:

an oven into which microwaves are applied;

a cylindrical rotary drum having a horizontal rotary shaft and rotatably disposed inside said oven, said rotary drum having an outer peripheral surface composed of a porous sheet-like microwave dielectric member;

a trough mounted in said oven below said rotary drum for storing a nitrate solution of a nuclear fuel material as a substance to be treated, said rotary drum extending into said trough whereby said outer peripheral surface of said rotary drum immerses into the nitrate solution when a predetermined amount of the nitrate solution is filled in said trough;

a heater disposed inside said oven above said rotary drum for heating said outer peripheral surface of said rotary drum;

a scraper disposed inside said oven for scraping off a denitrated product produced from the nitrate solution and formed on said outer peripheral surface of said rotary drum;

a solution feed port leading into said oven for supplying the nitrate solution into said trough;

a denitrated product discharge port leading out of said oven for discharging the denitrated product outside said oven; and a gas exhaust port leading out of said oven for exhausting a gas generated inside said oven;

whereby retention of the nitrate solution on said outer peripheral surface of said rotary drum, heating and denitration of the nitrate solution by microwaves, heating and drying of the denitrated product by said heater, and scraping-off of the denitrated product from said outer peripheral surface of said rotary drum are adapted to be carried out continuously and sequentially as said rotary drum rotates.

2. The continuous denitration apparatus according to claim 1, wherein a microwave shield plate is disposed around said heater.

3. The continuous denitration apparatus according to claim 1, wherein a temperature-controllable external heater is mounted on an outer wall of said trough and outside said oven.

4. The continuous denitration apparatus according to claim 1, wherein a temperature-controllable heater is disposed inwardly of said microwave dielectric member on said outer peripheral surface of said rotary drum.

5. The continuous denitration apparatus according to claim 1, wherein said porous sheet-like microwave dielectric member comprises a honeycomb sheet-like microwave dielectric member.

* * * * *